US005715611A

United States Patent [19]

Jacobs et al.

[11] Patent Number: 5,715,611

[45] Date of Patent: Feb. 10, 1998

[54] APPARATUS FOR CONTROLLING HUMIDITY

[75] Inventors: Merrit Nyles Jacobs, Fairport; Roger G. Leighton, Rochester; John J. Meyers, Penfield, all of N.Y.

[73] Assignee: Johnson & Johnson Clinical Diagnostics, Inc., Rochester, N.Y.

[21] Appl. No.: 734,058

[22] Filed: Oct. 18, 1996

Related U.S. Application Data

[60] Provisional application No. 60/008,225 Oct. 31, 1995.

[51] Int. Cl.[6] ..... F26B 19/00

[52] U.S. Cl. ..... 34/316; 34/355

[58] Field of Search ..... 34/216, 217, 207, 34/208, 236, 355, 557

[56] References Cited

U.S. PATENT DOCUMENTS

| | | | |
|---|---|---|---|
| 3,448,528 | 6/1969 | Jackson et al. | 34/9 |
| 3,536,523 | 10/1970 | Holt et al. | 117/119.6 |
| 4,014,747 | 3/1977 | Kenyon | 195/127 |
| 4,139,953 | 2/1979 | Gaskell | 34/216 |
| 5,043,143 | 8/1991 | Shaw et al. | 422/65 |

FOREIGN PATENT DOCUMENTS

| | | | |
|---|---|---|---|
| 2-208486 | 8/1990 | Japan | 34/216 |

*Primary Examiner*—Henry Bennett
*Assistant Examiner*—Dinnatia Doster
*Attorney, Agent, or Firm*—Dana M. Schmidt

[57] ABSTRACT

Humidity control apparatus for articles being stored, comprising: a) a chamber within which the articles are to be contained, b) a conveyor passing by a portion of, and exposed to, the contents of the chamber, c) a drive mechanism for driving the conveyor past the portion of the chamber, d) a desiccant on the conveyor, e) a humidistat positioned to measure the water vapor content within the chamber, and f) a control mechanism operatively connecting the humidistat and the drive mechanism for advancing fresh desiccant past the chamber when the water vapor content of the chamber is too high.

8 Claims, 4 Drawing Sheets

FIG. 3
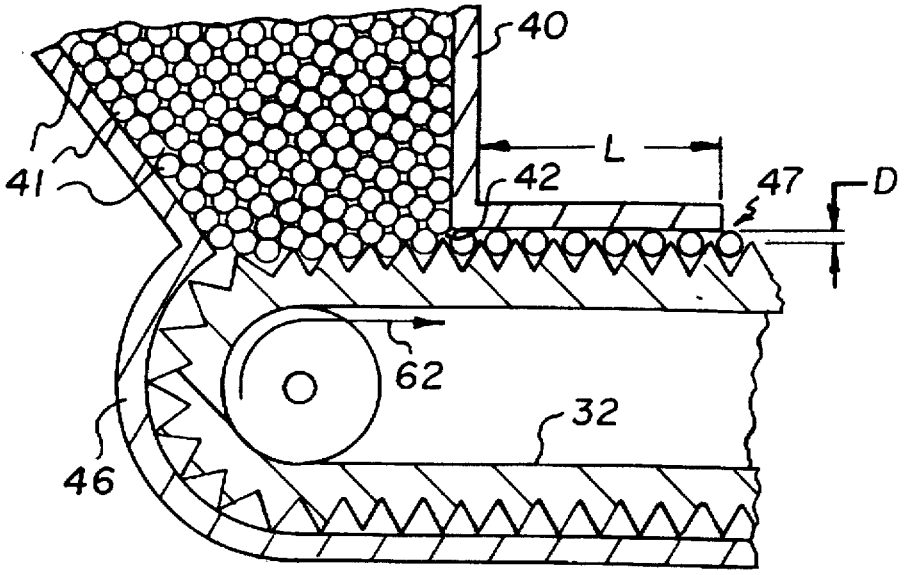
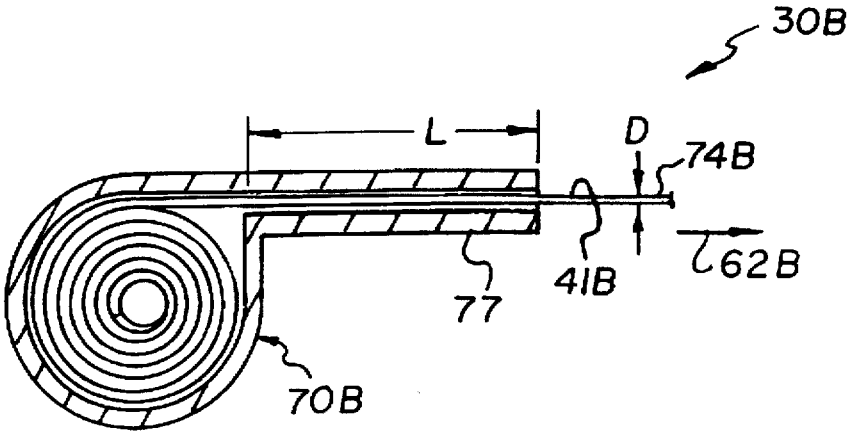
FIG. 5

APPARATUS FOR CONTROLLING HUMIDITY

CROSS-REFERENCE TO RELATED APPLICATION

This application claims the benefit of U.S. provisional application Ser. No. 60/008,225, filed on Oct. 31, 1995, entitled, Apparatus For Controlling Humidity.

FIELD OF THE INVENTION

This invention relates to apparatus including a storage chamber of articles needing control of relative humidity, and especially such a chamber used to store stacks of slide test elements.

BACKGROUND OF THE INVENTION

It is known in the field of clinical analyzers to provide a source of desiccant and a source of water vapor, to air that is circulated past stacks of slide test elements being stored (e.g., in cartridges). The purpose of course is to control the relative humidity (RH) of the slides. Such an arrangement is taught, for example, in U.S. Pat. No. 5,043,143. Typically, the source of desiccant is a bag of desiccant or a salt pad. Although such a system has worked for useful periods, the bags and salt pads do have a disadvantage—as they absorb moisture, their capability to absorb further moisture decreases. As a result, over time the relative humidity will start to drift above the optimum value that the bag or pad initially supplies. This necessitates a more or less periodic replacement of the pads—a labor-intensive task. Still another drawback is that the water source and desiccants were located in only one place, creating a long vapor path to the cartridges that need humidity control.

Accordingly, there has been a need prior to this invention to automatically control RH in storage chambers by the use of desiccants processed in a more automated manner that removes spent desiccant automatically, rather than by hand, preferably with a shorter vapor path.

SUMMARY OF THE INVENTION

We have designed a humidity control apparatus and method for an analyzer that solves the above-noted problems.

More specifically, in accord with one aspect of the invention, there is provided humidity control apparatus for a clinical analyzer, comprising a dryer and a chamber, the chamber comprising: a plurality of stacks of slide test elements, a support for the stacks, and means defining an opening at a side of the chamber, and the dryer comprising a conveyor mounted for moving past and spaced from, the opening, drive means for moving the conveyor past the opening, and desiccant deposited onto at least the portion of the conveyor that passes by the opening, so that drying of air around the stacks can be enhanced or reduced by increasing or decreasing, respectively, the rate of movement of the conveyor and desiccant past the opening.

In accord with another aspect of the invention, there is provided humidity control apparatus for articles being stored, comprising: a) a chamber within which the articles are to be contained, b) a conveyor passing by a portion of, and exposed to, the contents of the chamber, c) drive means for driving the conveyor past the portion of the chamber, d) a desiccant on the conveyor, e) a humidistat positioned to measure the water vapor content within the chamber, and f) control means operatively connecting the humidistat and the drive means for advancing fresh desiccant past the chamber when the water vapor content of the chamber is too high.

In accord with still another aspect of the invention, there is provided a method for drying out the contents of a storage chamber, the chamber having an opening in a side of the chamber, the method comprising the steps of: a) providing a source of fresh desiccant outside of the chamber, in a container closed except for an exit, b) when the chamber needs to have water vapor removed, withdrawing at a selected rate, some of the fresh desiccant out of the exit from the source on an elongated belt, and carrying the belt and the desiccant at least part way past the opening, and c) controlling the size of the opening together with the rate of withdrawal of the desiccant, consistent with the amount of water vapor to be removed.

Accordingly, it is an advantageous feature of the invention that it automatically provides fresh desiccant as needed, eliminating most of the labor heretofore required.

Other advantageous features of the invention will become apparent upon reference to the following Detailed Description, when read in light of the attached drawings.

BRIEF DESCRIPTION OF THE DRAWINGS

FIG. 3 is an enlarged, fragmentary elevational view of the portion of FIG. 1 marked "III";

FIG. 5 is a fragmentary sectional view similar to FIG. 3, but of variation of the embodiment of FIG. 4.

DETAILED DESCRIPTION OF THE PREFERRED EMBODIMENTS

The invention is described in connection with preferred embodiments in which a conveyor of preferred form carries a desiccant in a preferred form, past an opening in fluid communication with the bottom side of a chamber that stores cartridges of slide test elements in a clinical analyzer. In addition, the invention is useful regardless of the form of the conveyor, the type of desiccant, and regardless of the manner in which the slide test elements are stacked (whether or not in cartridges). It is further useful regardless of the articles being stored, and regardless which side of the chamber the desiccant passes by.

Figure 1:
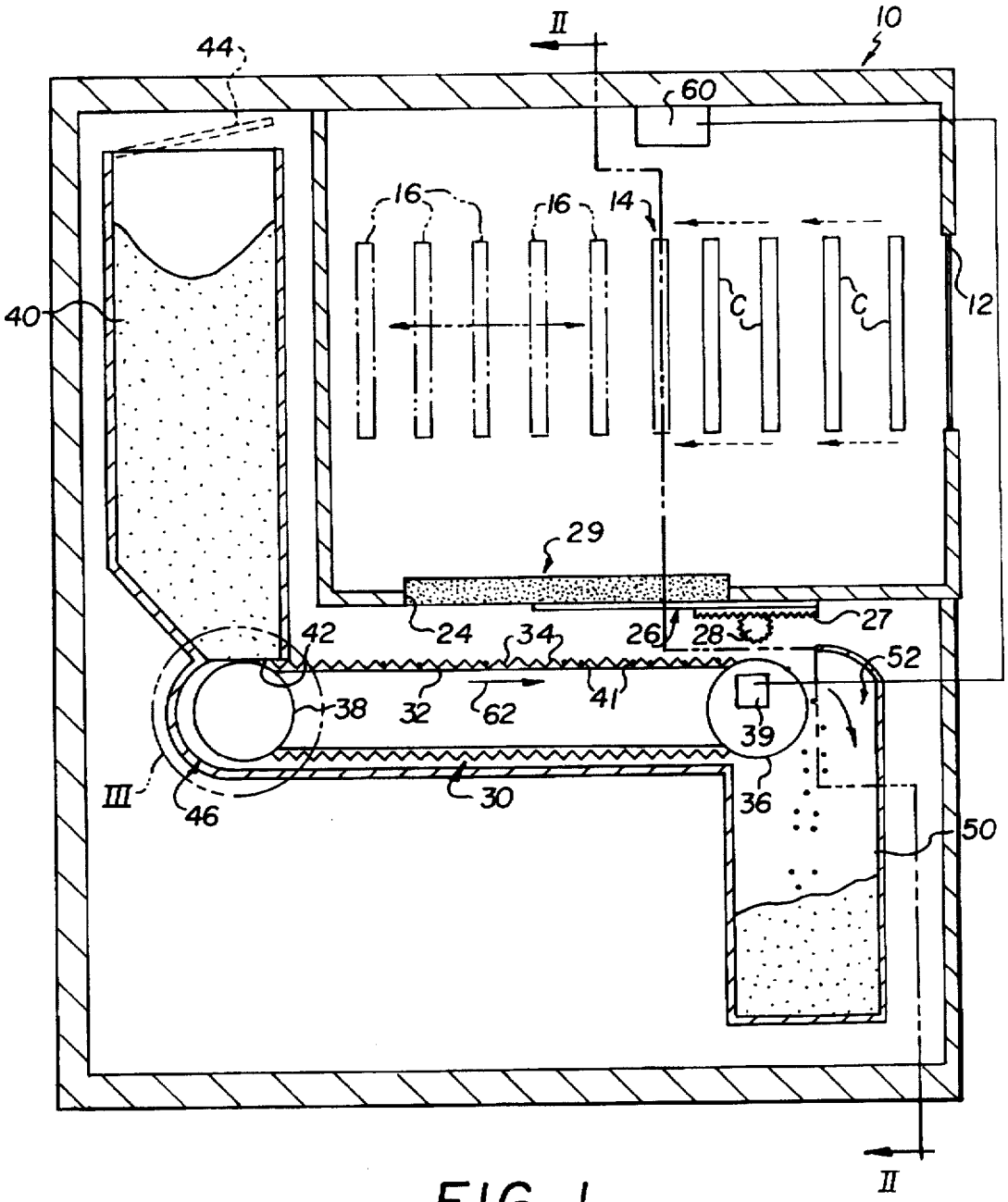
FIG. 1 is a partially schematic elevational view in section of an analyzer using the humidity control chamber of the invention.

Thus, the stored stacks for which humidity is to be controlled are preferably cartridges C, FIG. 1, of slide test elements, such as those available under the trademark "Ektachem"® from Johnson & Johnson Clinical Diagnostics, Inc. The cartridges can be mounted by any suitable mechanism 11, FIG. 2, within chamber 10 for storage, for example, the mechanisms shown in U.S. Pat. No. 5,043,143. Chamber 10 can be linear as shown, FIG. 1, so that the cartridges individually move from an input opening 12 having a door closure (not shown) to a dispense station 14 where slide test elements are taken off the top of the cartridges by a pusher blade 18, FIG. 2, as in conventional. Further storage occurs at the positions 16 shown in phantom, FIG. 1. Alternatively, chamber 10 can be a torus (not shown) so that the cartridges move around in a ring, e.g., as shown in U.S. Pat. No. 5,089,418. In any case, chamber 10 is preferably part of a clinical or chemical analyzer, the remainder of which is conventional, for example, that which is shown in the '418 patent.

Figure 2:
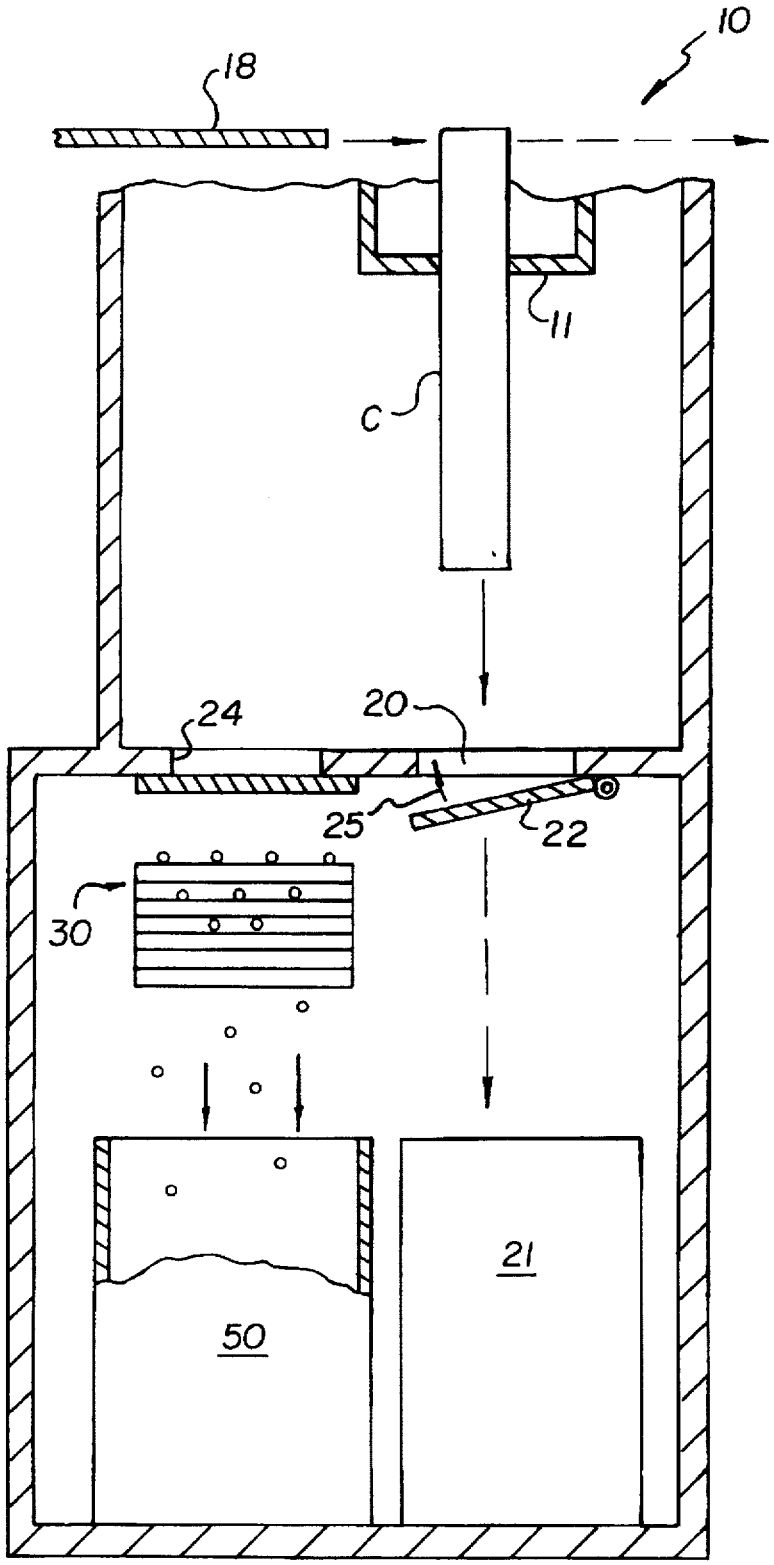
FIG. 2 is a section view taken generally along the line II—II of FIG. 1.

Chamber 10 includes two openings, FIG. 2, at the bottom—opening 20 for dumping spent cartridges into a waste box 21, and opening 24 described hereinafter. Opening 20 can be covered by a movable door 22, for example, a pivoting door operated by a stepper motor (not shown), or operated by a torsion spring biased upwardly, arrow 25, that however is overcome by the weight of a cartridge released from mechanism 11.

Opening 24 is present to provide for fluid (air and water vapor) communication in and out of chamber 10, FIG. 1. A movable door 26, for example, a sliding door, is mounted below opening 24, and is driven by any suitable means, e.g., a rack 27 on the door, a pinion gear 28, and a stepper motor, not shown.

Optionally, a filter 29 is placed in opening 24 to filter out desiccant dust.

When and to the extent door 26 is open, chamber 10 and cartridges C are in fluid communication with the environment outside chamber 10, and specifically a dryer to dry out the contents of chamber 10. The dryer comprises a conveyor 30 mounted below opening 20. As shown, conveyor 30 is an endless belt 32 with corrugations or pockets 34, or a double tooth timing belt. It is driven by drive pulley 36 and idler pulley 38. Any suitable drive motor 39 drives pulley 36.

Disposed above one of the pulleys 36,38, such as idler pulley 38, is a container 40 holding a desiccant powder 41 in bulk form. Container 40 is generally closed but is open at bottom end 42, FIG. 3, such as a bottle, and positioned close adjacent to belt 32. A door 44 is provided at the top of container 40, FIG. 1, to allow operator access for refilling the container. An optional back shield 46, FIG. 3, is provided upstream of container 40, secured to open end 42, to prevent spillage outside of the conveyor. Preferably, the desiccant door and exit interfaces are vapor sealed to prevent spoilage of contents. A long horizontal vapor diffusion tunnel 47 provides sufficient particulate desiccant life within container 40, by the proper selection of L>>>D.

At the end of conveyor 30 opposite to container 40, FIG. 1, is placed a waste bin 50 open at its upper end 52 to receive spent desiccant as it falls off belt 42.

The analyzer includes a conventional computer (not shown), which among other things acts to drive pulley 36 when drier conditions are required. To sense the relative humidity within chamber 10, a humidistat 60 of conventional construction is located within chamber 10, such as in the middle to reduce RH gradients, and this humidistat signals the computer when fresh desiccant is required. At this time pulley 36 is rotated an amount sufficient to advance belt 32 to the right, arrow 62, a predetermined amount, so as to withdraw fresh desiccant from container 40 and to bring it past opening 24. Additionally, door 26 is optionally opened further than previously. The rate of movement of belt 32, arrow 62, and door 26, is adjusted depending upon the need for more, or less, drying effect from the fresh desiccant moved into position. For example, humidistat 60 is set for a control humidity of, e.g., 15% RH or 33% RH, depending on which chemistries are present in cartridges C. Then, when the RH increases above the control setting by 2% or more, motor 39 is turned on a predetermined amount. However, the exact control point of the relative humidity, and the amount of increase that occurs before triggering motor 39, is a function of the needs of the analyzer, which can vary.

Alternatively, if exterior conditions dictate the need for greater moisture, not less, belt 32 can be reversed in the direction opposite to arrow 62, presenting less desiccant and/or less fresh desiccant to opening 24.

Because belt 32 has considerable linear extension, it is no longer the case, as in prior construction, that the operative desiccant is confined to a single location, necessitating a longer flow path to all parts of the storage chamber.

As to the desiccant, any conventional powdered or loose desiccant can be used. Examples include molecular sieves, which generally are diatomaceous earth baked at 300° C., as well as silica gel.

It is not necessary that the desiccant be in loose form, or that conveyor 32 be grooved and endless. For example, FIGS. 4 and 5, the desiccant can be attached permanently to the conveyor, which is in roll format, rather than continuous. Parts similar to those previously described, bear the same reference numeral, to which the distinguishing suffix "A" or "B" are appended. Thus, chamber 10A has cartridges C fed into it via opening 12A for movement past dispense station 14A and to storage positions 16A. An opening 24A and removable door 26A allow fluid communication between chamber 10A and a conveyor 30A disposed adjacent and below opening 24A, and an optional filter 29A can be placed in opening 24A, all as described heretofore.

However, conveyor 30A is in roll format, having an unused reel 70 and a take-up reel 72 and driven by motor 39A. The material itself of the roll is a generally flat strip 74 to which is attached by a suitable adhesive, the desiccant (both shown as layer 41A). Alternatively, it can be a woven or fibrous material with desiccant embedded therein. Various mechanisms can be used to keep fresh the unused strip portions on reel 70, for example, a spring-biased trap door 76 that rides lightly on strip 74, or alternatively, FIG. 5, a small exit snout 77 having a length L that, compared with the opening D of snout 77, limits air access to the unused reel portion 70B of conveyor 30B, as noted above for tunnel 47. This construction leaves strip 74B free from contact with stationary parts as it unwinds, arrow 62B.

Figure 4:
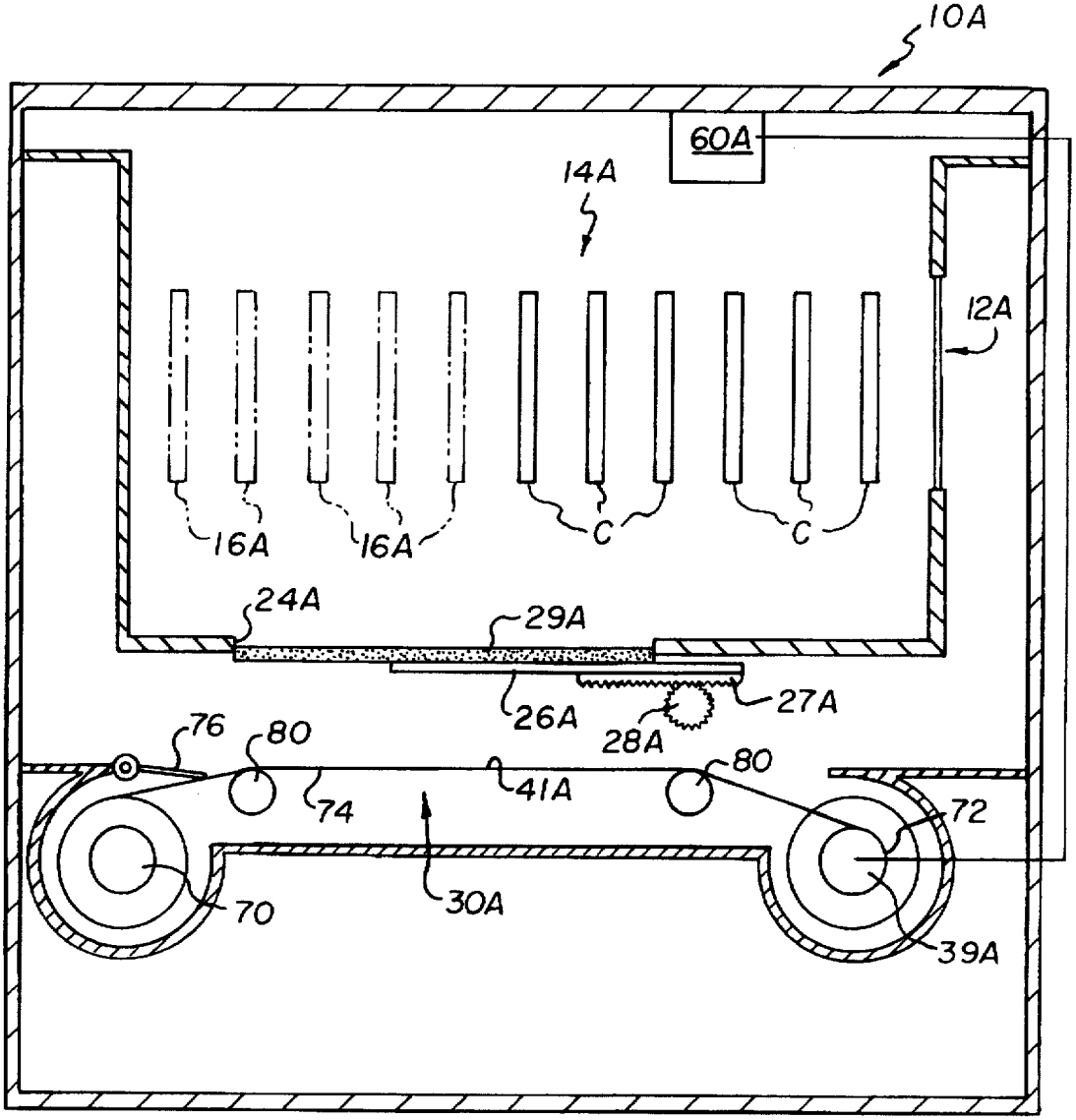
FIG. 4 is an elevational view similar to that of FIG. 1, but of an alternate embodiment.

Idler rollers 80 can be used, FIG. 4, to move strip 74 closer to opening 24A.

In this embodiment, the desiccant can be in a form similar to that of the embodiment of FIG. 1. Any suitable adhesive can be used to attach it to the strip, for example, poly (diethylene glycol-co-dimethyl 1,3-cylohexanedicarboxylate-co-neopentyl glycol), or a UV or visible-light curable modified acrylic adhesive available under the tradename "Acrylic 3211" from Loctite Corp. The latter material has a viscosity of about 10,000 cp and no or minimal solvent outgassing. The attachment is done by ensuring that significant surface areas of the desiccant project above the adhesive layer, to ensure exposure of the desiccant to the air.

It is further possible to supply a water source adjacent to the conveyor and desiccant, controlled by a door that opens or closes, as more or less moisture is needed, respectively. Construction can be similar to that shown in U.S. Pat. No. 5,043,143, the details of which are expressly incorporated herein by reference. The water is preferably in a single site and is not conveyed on a conveyor, unlike the desiccant. This alternative is especially desirable when using a 33% RH control as noted above in the discussion of humidistat 60.

The invention disclosed herein may be practiced in the absence of any element which is not specifically disclosed herein.

The invention has been described in detail with particular reference to preferred embodiments thereof, but it will be understood that variations and modifications can be effected within the spirit and scope of the invention.

What is claimed is:

1. Humidity control apparatus for a clinical analyzer, comprising a dryer and a chamber, said chamber comprising:

a plurality of stacks of slide test elements;

a support for said stacks; and means defining an opening at a side of said chamber;

and said dryer comprising a conveyor mounted for moving past and spaced from, said opening;

drive means for moving said conveyor past said opening; and desiccant deposited onto at least the portion of said conveyor that passes by said opening, so that drying of air around said stacks can be enhanced or reduced by increasing or decreasing, respectively, the rate of movement of said conveyor and desiccant past said opening.

2. Apparatus as defined in claim 1 wherein said desiccant is attached to said conveyor.

3. Apparatus as defined in claim 2, wherein said desiccant is attached by adhesive.

4. Apparatus as defined in claim 1, wherein said conveyor is an endless belt mounted on two rotating pulleys.

5. Apparatus as defined in claim 4, wherein said belt comprises pockets for holding loose desiccant in place.

6. Apparatus as defined in claim 4, wherein said desiccant is supported loosely on but not attached to said belt, and further including a collection box disposed adjacent one of said pulleys and below said belt, to collect said desiccant as it falls when said belt passes over said one pulley and is inverted.

7. Humidity control apparatus for articles being stored, comprising:

a) a chamber within which said articles are to be contained;

b) a conveyor passing by a portion of, and exposed to, the contents of said chamber;

c) drive means for driving said conveyor past said portion of the chamber;

d) a desiccant on said conveyor;

e) a humidistat positioned to measure the water vapor content within said chamber; and f) control means operatively connecting said humidistat and said drive means for advancing fresh desiccant past said chamber when the water vapor content of said chamber is too high.

8. A method for drying out the contents of a storage chamber, said chamber having an opening in a side of the chamber, the method comprising the steps of:

a) providing a source of fresh desiccant outside of said chamber, in a container closed except for an exit;

b) when the chamber needs to have water vapor removed, withdrawing at a selected rate, some of said fresh desiccant from said source out of said exit on an elongated belt, and carrying said belt and said desiccant at least part way past said opening; and c) controlling the size of said opening together with said rate of withdrawing of the desiccant, consistent with the amount of water vapor to be removed.

* * * * *